US006032581A

United States Patent [19]

Beutler et al.

[11] Patent Number: 6,032,581

[45] Date of Patent: Mar. 7, 2000

[54] REGISTER CONTROL DEVICE FOR A PRINTING MACHINE

[75] Inventors: Thomas Beutler, Munster; Christopher Muth, Muhlheim; Michael Rother, Rodermark; Helmut Schild, Steinbach/Ts; Peter Biernot, Offenbach; Franz Reiner, Oberursel, all of Germany

[73] Assignee: MAN Roland Druckmaschinen AG, Germany

[21] Appl. No.: 09/379,273

[22] Filed: Aug. 23, 1999

[30] Foreign Application Priority Data

Aug. 28, 1998 [DE] Germany ..... 198 39 149

[51] Int. Cl.[7] ..... B41L 47/14

[52] U.S. Cl. ..... 101/477; 101/415.1; 101/486; 101/DIG. 36

[58] Field of Search ..... 101/415.1, 477, 101/484, 485, 486, DIG. 36; 33/614, 617, 618, 619, 623, 621

[56] References Cited

U.S. PATENT DOCUMENTS 5,299,498 4/1994 Spiegel et al. ..... 101/477
5,383,402 1/1995 Takano et al. ..... 101/415.1
5,479,859 1/1996 Lindner et al. ..... 101/485
5,511,478 4/1996 Lindner et al. ..... 101/477
5,634,406 6/1997 Lindner et al. ..... 101/486

FOREIGN PATENT DOCUMENTS 43 39 344 C1 3/1995 Germany .

*Primary Examiner*—Christopher A. Bennett
*Attorney, Agent, or Firm*—Leydig, Voit & Mayer, Ltd.

[57] ABSTRACT

The present invention generally describes register control equipment for the cylinder of a printing machine. It specifically pertains to the printing plate of sheet-fed offset printing machine that has fitted register pins. The register pins are electrically insulated with respect to the cylinder and emit a signal when a printing plate is resting in register on one or more of the pins. The signal is communicated to a stationary evaluation unit by an electrical contact adapted to contact the printing plate. The evaluation unit uses the communicated signal to determine whether or not insertion was properly performed.

8 Claims, 2 Drawing Sheets

REGISTER CONTROL DEVICE FOR A PRINTING MACHINE

TECHNICAL FIELD

This invention relates generally to printing machines and, more particularly, to a register control device for a printing machine.

BACKGROUND OF THE INVENTION

In a sheet-fed offset printing machine, a printing plate is fastened on a plate cylinder by means of a clamping rail allocated to the leading edge of the printing plate and a clamping rail allocated to the trailing edge. An example of such a printing machine may be seen in U.S. Pat. No. 5,511,478 (DE 43 39 344 C1) which discloses a device for the automatic changing of printing plates in a printing machine. Here, a printing plate, which is to be inserted, has certain built in guards to stop movement and a guide device to assist its contact with the cylinder and insertion into the clamping rail of the edges. After this plate has been inserted into the clamping rail and the plate's leading edge has been clamped, the plate is drawn onto the cylinder by the latter being rotated forwards. During insertion into the leading edge clamping rail and the drawing process, the central or rear part of the printing plate still makes contact with the guard.

To assure high print quality, printing plates are usually fitted to the plate cylinder in a precise location using a register system. For example, U.S. Pat. No. 5,383,402 (EP 0 551 976 A1) discloses a register system for mounting a plate on a plate cylinder that includes a plate lockup device, reference pins and a lamp. The plate lockup device is provided in a gap formed in the circumference surface of the plate cylinder. The reference pins are electrically rendered conductive by contacting an insertion end of a plate inserted into the plate lockup device, thereby detecting insertion of the plate. The lamp confirms and indicates insertion of the plate from an output from the reference pins thereby allowing a manual installation of a printing plate to visually verified.

While the register system disclosed in this patent does work for its intended purpose, it does suffer disadvantages. For example, the register system suffers the disadvantage of requiring extra space for the contact areas on the cylinder and for the rollers on the frame. Additionally, these rollers also increase outlay on construction. Still further, any soiling of the contact areas or the contacts/rollers could result in an erroneous signal transmission.

SUMMARY OF THE INVENTION

To overcome these disadvantages, the present invention is generally realized in an expanded register control system for a cylinder of a printing machine. The system is adapted to form a simple electrical circuit and contains register pins that are fitted so as to be electrically insulated with respect to the printing machine cylinder. Signals are generated by a signal generator that is connected to the register pins via the cylinder. When a new printing plate is inserted a signal is sent that contains a pulse train to the register pins. The pulse should be comprised of a predefined frequency and duration. If the printing plate is in the in-register position, i.e. connected properly to the cylinder, the printing plate will assume the potential/pulse train of the register pins.

Using an electrical contact, the pulse train assumed by the printing plate is transferred to a control system. Within the control signal, the pulse train is evaluated and compared to a predefined potential. If the pulse train assumed by the printing plate matches the predefined potential, then the plate is known to have been inserted correctly. Otherwise, the system will assume the printing plate is not in the correct position.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 1:
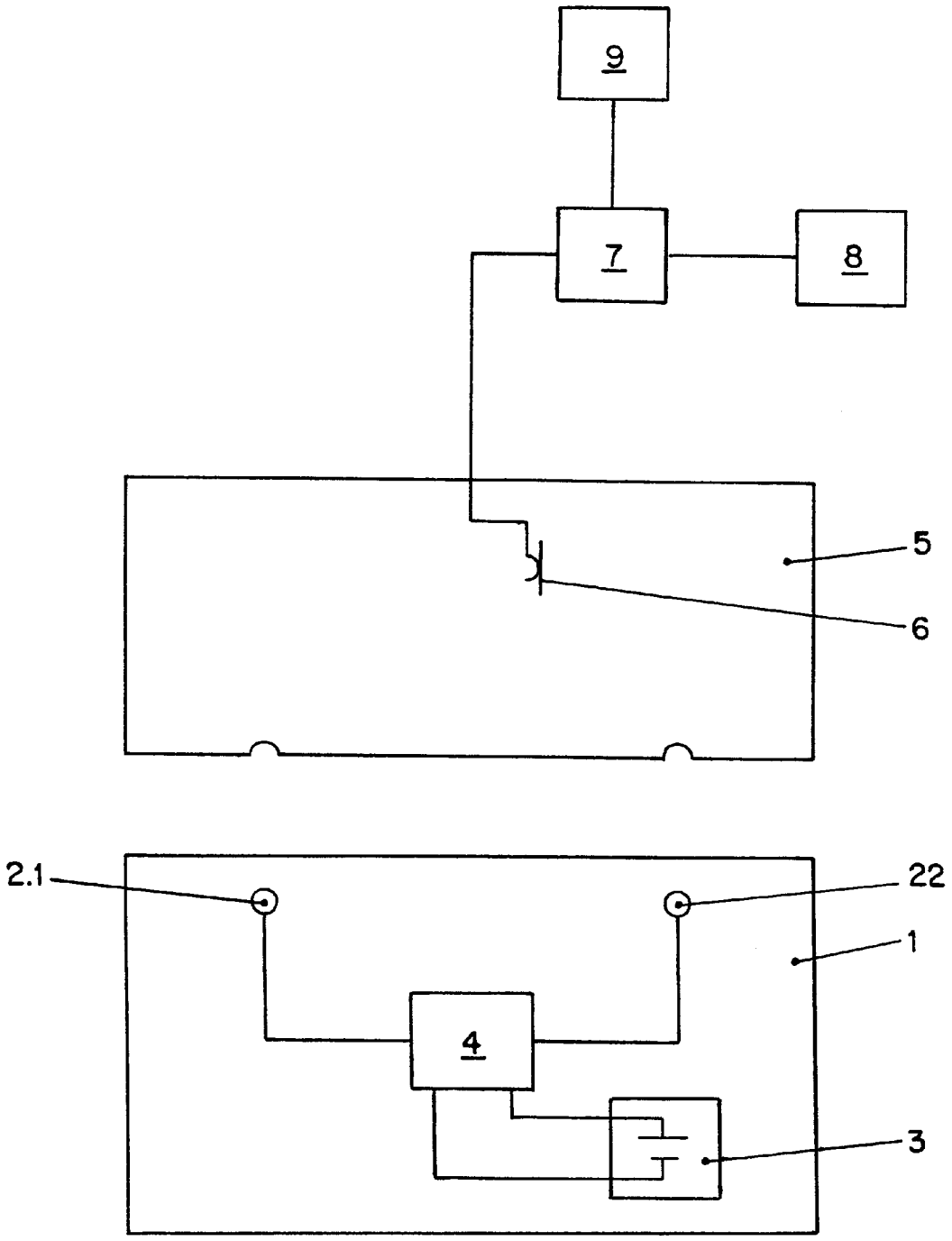
FIG. 1 is a diagram that shows the basic circuit of the present invention.

Turning now to the figures, wherein like references refer to like elements, there is illustrated in FIG. 1 an example of a printing machine in which the present invention resides. In this regard, FIG. 1 shows the position of the printing plate 1 in its isolated state without any contact with the register pins 2.1 and 2.2. The register pins 2.1 and 2.2 are electrically insulated inside the cylinder 1. The cylinder 1, which may be a plate cylinder, printing-forme, etc, has the two register pins 2.1 and 2.2 in a clamping rail (not shown). A power supply 3 is also within the cylinder 1, as well as a signal generator 4. The power supply may be any source of power like a battery or rechargeable battery, and it is connected to the signal generator 4. The clamping rail is assigned to the leading edge of the printing plate 5. The register pins being fitted so that they can be electronically insulated with respect to the clamping rail and the entire cylinder 1. The register pins 2.1 and 2.2 have a signal connection to a signal generator 4. The signal is in the form of pulses. The printing plate 5 is inserted into the cylinder 1. During the insertion process, the signal generator 4 brings the register pins 2.1 and 2.2 to predefined electric potentials.

On the leading edge of the cylinder 1 are two U-shaped grooved notches, which match up with the register pins 2.1 and 2.2 in a manner known to those skilled in the art. The rear side of the printing plate 5 is assigned to the contact 6. The potential of the printing plate 5 can then be read via the contact 6 and sent to an evaluation unit 7. The evaluation unit 7 is fixed to the frame and has a signal connection to an indicator 9. The evaluation unit 7 is also connected to a control system 8. The control system 8 monitors the entire printing plate changing process; in particular to the opening and closing of the leading edge clamping rail in the cylinder 1 which it may also trigger. The pulses from the signal generator 4 are sent in such a way that the signal that reaches evaluation unit 7 can determine which register pin 2.1 and/or 2.2 that printing plate 5 is resting in-register and which register pin 2.1 and/or 2.2 it is not resting in-register.

Figure 2:
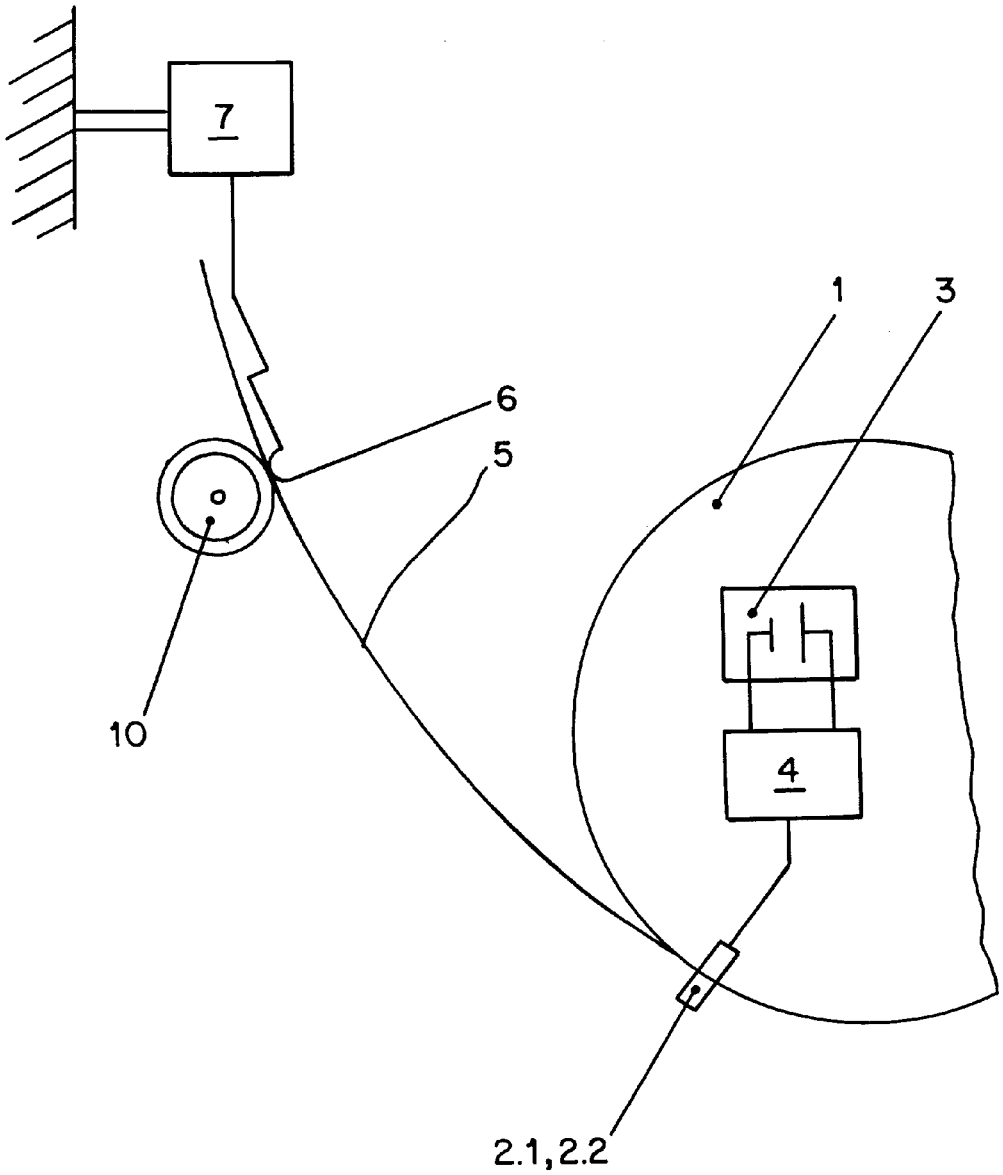
FIG. 2 is a diagram that shows the arrangement of a wiping contact and its action on the rear side of the printing plate.

FIG. 2 shows a side view of part of the cylinder 1 with the printing plate 5 resting on the electrically insulated register pins 2.1 and 2.2. The printing plate 5 is inserted into the cylinder 1 through a guard (not shown) via a roller 10. The roller 10 interacts with the printing side of the printing plate 5 and is generally made from electrically insulated materials. The contact 6 is fitted opposite of the roller 10 in the guard and interacts with the uncoated rear side of the printing plate 5. The contact 6 is in the form of a wiping contact, which is an electrically conductive roller or brush. The contact 6 can register the electric potential of the register pins 2.1 and 2.2 and forward that information to the stationary evaluation unit 7. The stationary unit establishes the in-register position by measuring the electric potential of the printing plate 5 and comparing it to the applied potential of the register pins 2.1 and 2.2. If the printing plate 5 was inserted correctly, the clamping rail in the cylinder 1 should close and the printing plate 5 should draw onto the cylinder 1.

In the preferred embodiment of the invention, the register pins are electrically insulated with respect to the clamping rail and the entire cylinder. A signal generator located within the cylinder should bring the register pins to a specific potential via pulses (coded signals) that are of a predefined frequency and duration. The signal generator can be connected to any sort of power supply that can provide it the necessary power to generate the pulses. The signal generator may be modified so that when the two register pins are in the cylinder the pulses to each register pin are different. The printing plate, which is electrically insulated with respect to the cylinder and the clamping rails, should assume the potential of the pulse train sent to one of the individual register pins. It should assume the potential of the register pin that it first comes in contact with. A stationary evaluation unit is connected via a contact to the printing plate. The contact is usually near the rear end of the printing plate and may be a wiping contact, electrically conductive roller, electrically conductive brush, or a similar material. Thus, this stationary evaluation unit may be able to establish which of the register pins the printing plate first rests in-register and eventually whether both register pins are in-register. When both register pins are in-register, the control system connected to the evaluation unit can trigger the clamping operation. The evaluation unit may also be connected to other devices, such as an indicator and/or a control system. The indicator can determine and display whether the printing plate is resting in-register and whether each of the register pins are in the proper position. The control system may monitor the entire printing plate change operation, and it may initiate and terminate this process.

The process of reading the signals is done near the read end of the printing plate. Electrically conductive materials such as rollers, wipers, or brushes can be used to read the signal. Preferably, this invention is used with a printing plate changer, which is known to those skilled in the art. The printing plate that is to be inserted should be guided by a guard before it is changed, while it is being inserted, and while it is being drawn onto a cylinder.

In a sheet-fed offset printing machine, aluminum printing plates, which are uncoated on the non-printing rear side, may be used. A printing plate changer can be constructed along the guidelines known to those skilled in the art and combined with the present invention by fitting an electrically conductive object such as a roller, wiping contact, or brush. This object is arranged in such a way with the guard of the printing plate changer that the electrical potential of the printing plate can be measured off the rear side of the printing plate. The signal is sent to the stationary evaluation and control unit. The parts, which guide the printing plate, are made of electrically insulated design such as electrically non-conducive plastic.

All of the references cited herein, including patents, patent applications, and publications, are hereby incorporated in their entireties by reference.

In view of the many possible embodiments to which the principles of this invention may be applied, it should be recognized that the embodiment described herein with respect to the drawing figures is meant to be illustrative only and should not be taken as limiting the scope of invention. Therefore, the invention as described herein contemplates all such embodiments as may come within the scope of the following claims and equivalents thereof.

We claim:

1. A register control device for a printing machine comprising a cylinder and an electrically conductive printing plate, the device comprising:

a pair of register pins associated with the cylinder which are electrically insulated with respect to the cylinder;

a signal generator in communication with the register pins;

a contact adapted to make an electrical connection with the printing plate; and an evaluation unit in electrical communication with the contact;

wherein the signal generator sends to each of the register pins a unique signal transferable to the printing plate when the register pins are in register with the printing plate and wherein the contact is adapted to communicate the signals from the printing plate to the evaluation unit.

2. The device of claim 1 wherein the contact interacts with the rear end of the printing plate.

3. The device of claim 1 wherein the contact is a wiping contact.

4. The device of claim 1 wherein the contact is an electrically conductive contact roller.

5. The device of claim 1 wherein the contact is an electrically conductive brush.

6. The device of claim 1 wherein the contact engages the printing side of the printing plate.

7. The device of claim 1 wherein the unique signal supplied to each of the register pins is a predefined pulse train.

8. The device of claim 1 wherein the signal generator applies the pulse train to the register pins in a manner by which the evaluation unit may distinguish pulse trains from each distinct register pin.

* * * * *